US007409995B2

(12) United States Patent
Moynahan

(10) Patent No.: US 7,409,995 B2
(45) Date of Patent: Aug. 12, 2008

(54) APPARATUS AND METHOD FOR WASHING TUBULAR CONDUITS DURING TRIP OUT OF A CONDUIT STRING FROM WITHIN A SUBTERRANEAN WELL

(76) Inventor: Jon-Paul C. Moynahan, 634 Ames St., Spring, TX (US) 77373

( * ) Notice: Subject to any disclaimer, the term of this patent is extended or adjusted under 35 U.S.C. 154(b) by 359 days.

(21) Appl. No.: 10/842,342

(22) Filed: May 5, 2004

(65) Prior Publication Data

US 2007/0256839 A1 Nov. 8, 2007

(51) Int. Cl.
*E21B 19/00* (2006.01)

(52) U.S. Cl. ..... 166/311; 166/90.1; 166/88.4

(58) Field of Classification Search ..... 166/88.1, 166/88.4, 81.1, 84.1, 90.1, 177.3, 222, 223, 166/311

See application file for complete search history.

(56) References Cited

U.S. PATENT DOCUMENTS 3,943,997 A * 3/1976 Davis ..... 166/312
4,895,205 A * 1/1990 Thompson et al. ..... 166/90.1
5,101,896 A * 4/1992 Thompson et al. ..... 166/90.1
5,526,877 A * 6/1996 Winz ..... 166/88.2
6,119,772 A * 9/2000 Pruet ..... 166/81.1
6,415,861 B1 * 7/2002 Harrison et al. ..... 166/81.1

* cited by examiner

*Primary Examiner*—William P Neuder
(74) *Attorney, Agent, or Firm*—Beirne, Maynard and Parsons L.L.P

(57) ABSTRACT

An apparatus for washing undesirable matter off of the exterior of tubular conduits forming a conduit string during trip out of the conduit string within a subterranean well. The tubular conduits may be drill or workover pipe, or the like. A cylindrical housing has first and second opposite ends. A removable elastomeric seal means is provided across each of the first and second ends. The seal means is selectively secured relative to the housing. Each seal means defines an open passageway therethrough and which is centrally positioned there across. The open passageway through each seal means is sized for introduction, of the tubular conduits into and out of the cylindrical housing and the seal means. A circumferentially extending lip area of each seal means faces toward the respective passageways for snug, wiping contact around the exterior of the tubular conduits during movements of the conduit string into and out of the cylindrical housing.

19 Claims, 7 Drawing Sheets

APPARATUS AND METHOD FOR WASHING TUBULAR CONDUITS DURING TRIP OUT OF A CONDUIT STRING FROM WITHIN A SUBTERRANEAN WELL

BACKGROUND OF THE INVENTION (1) Field of the Invention

The invention relates to an apparatus and method for washing undesirable matter off of tubular conduits as they are withdrawn during a trip out from within a subterranean well.

(2) Brief Description of the Prior Art

Subterranean wells are commonly drilled and worked over for the purpose of recovering water or hydrocarbon constituents, such as oil and gas. These wells may be found on land or upon platforms or drill ships on the oceans and seas through the world. For example, FIGS. 1A and 1B illustrate a typical inland rotary drilling rig and its components. A subterranean well W is shown with set casing C secured in place by cement column C-1. A conduit string CS is shown inserted within the well W and interior of the casing C. The conduit string CS is formed by a number of tubular conduits TC which are threaded one to another at each end at respective collars or upset portions TCC. Drill collars DC are secured along the tubular conduits TC with a drill bit DB at the lowermost end of the conduit string CS. A conductor pipe CP extends within the uppermost portion of the well W to a casinghead CH in a cellar CHC at the top surface of the well W. A stack of ram blowout preventers RBOP is placed on the casinghead and an annular blowout preventer ABOP is secured to the top of the ram blowout preventers RBOP. The conduit string CS is inserted into and withdrawn from the well W through the blowout preventers RBOP and ABOP and through a kelly bushing KB and rotary table RT extending through an opening RTO in the rig floor RF. A Kelley K extending from a swivel S suspended from a traveling block TB enables the conduit string CS to be inserted and removed during tripping into or out of the well W. The conduit string CS is made up at the rig floor RF by roughnecks RN manipulating power tongs PT to secure or remove one tubular conduit TC to or from another tubular conduit TC during make up or disassembly of the conduit string CS.

As the conduit string CS is withdrawn from the well W during a trip out, the exterior of each tubular conduit TC will have considerable undesirable matter upon such exterior. This "undesirable matter" may include both liquids and solids, such as aqueous and oil based or emulsion drilling or workover fluids, barite, bentonite, polymers, well cuttings, acidic or basic corrosion inhibitors, flocculants, dispersants, shale, and other materials commonly found within the well as the result of the drilling or workover operation. Even though the roughnecks may wear special gloves and clothing, it is not at all unusual for these personnel to get a considerable amount of this undesirable matter upon their clothing, and even on their skin, in their eyes, and such, during the tripping operation. If the undesirable matter is acidic, it can cause a burning sensation upon contact with human skin. Moreover, especially on offshore wells, this undesirable matter constitutes an environmental hazard if it is not properly and immediately collected and carefully disposed of, to avoid dumping into the ocean or other environmentally sensitive area.

The present invention addresses the concerns as above described.

SUMMARY OF THE INVENTION

The present invention provides an apparatus for washing undesirable matter off of the exterior of tubular conduits forming a conduit string during trip out of the conduit string within a subterranean well. The tubular conduits may be drill or workover pipe, or the like. A cylindrical housing has first and second opposite ends. A removable elastomeric seal means is provided across each of the first and second ends. The seal means is selectively secured relative to the housing. Each seal means defines an open passageway therethrough and which is centrally positioned there across. The open passageway through each seal means is sized for introduction of the tubular conduits into and out of the cylindrical housing and the seal means. A circumferentially extending lip area of each seal means faces toward the respective passageways for snug, wiping contact around the exterior of the tubular conduits during movements of the conduit string into and out of the cylindrical housing.

Wash means, which may include jet nozzles, are placed circumferentially within and around the interior of the cylindrical housing for directing a cleaning fluid under pressure toward and upon the tubular conduits as the conduit string passes through the cylindrical housing during trip out from within the subterranean well.

The cleaning fluid may comprise a number of constituents. The cleaning fluid may be solely fresh water, brine, or seawater, or any combination thereof. It may be heated or converted to steam. It may contain a host of additives, such as demulsifiers, detergents, and the like. If it is to be recycled for subsequent use in the apparatus, it should be filtered and otherwise cleaned for removal of undesirable matter.

The apparatus of the present invention also comprises means, such as a wash fluid conduit including a cylindrical ring affixed to the interior surface of the cylindrical housing, the wash fluid conduit being in fluid communication with the wash means and with a source of cleaning fluid.

The seal means incorporated into the present invention may serve up to three functions. First, in combination with the cylindrical housing, it defines a chamber within which the washing procedure is conducted. Secondly, it provides snug engagement of the apparatus onto the tubular conduits during the trip out of the conduit string from within the subterranean well. Finally, the seal permits the chamber to be placed in a vacuum by a vacuum means for suction of the cleaning fluid containing the undesirable matter out of the apparatus during the washing procedure.

The pressure of the cleaning fluid directed upon the tubular conduits being cleaned is maintained between about 100 p.s.i. and about 10,000 p.s.i. during washing of the tubular conduits within the housing. Heating means may also be included as part of the apparatus for heating of the cleaning fluid at any desired temperature, including conversion into steam.

DESCRIPTION OF THE PREFERRED EMBODIMENTS

Figure 1A:
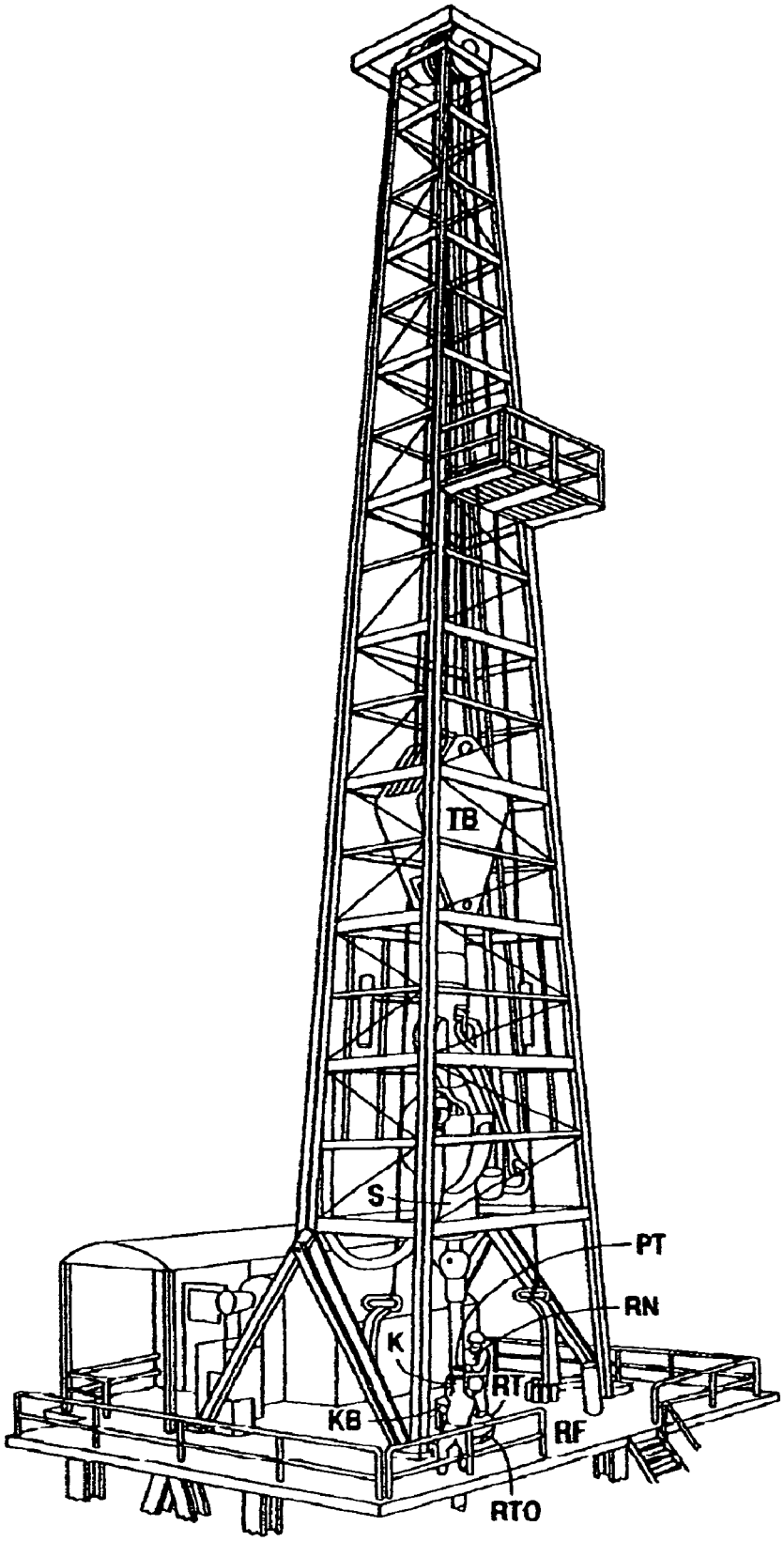
FIGS. 1A and 1B together constitute a schematic illustration of the components of a typical rotary drilling rig, with the apparatus of the present invention shown in position below the rig floor and above the respective stacks of blowout preventers.
Figure 1B:
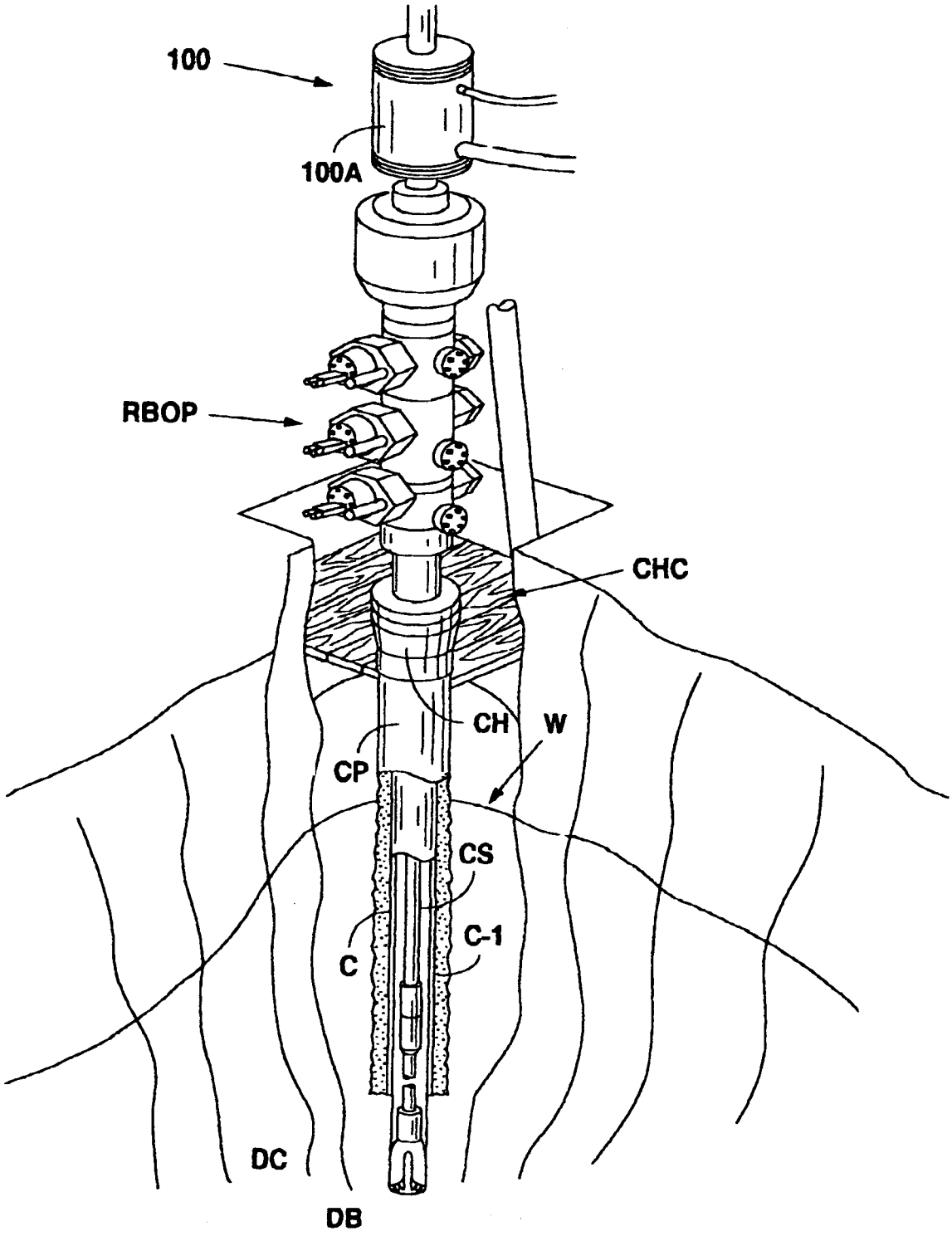

Now, first referring to FIG. 1B, the apparatus 100 of the present invention includes a cylindrical housing 100A which is shown as preferably positioned for operation just above the upper end of an annular blowout preventer ABOP.

Figure 2:
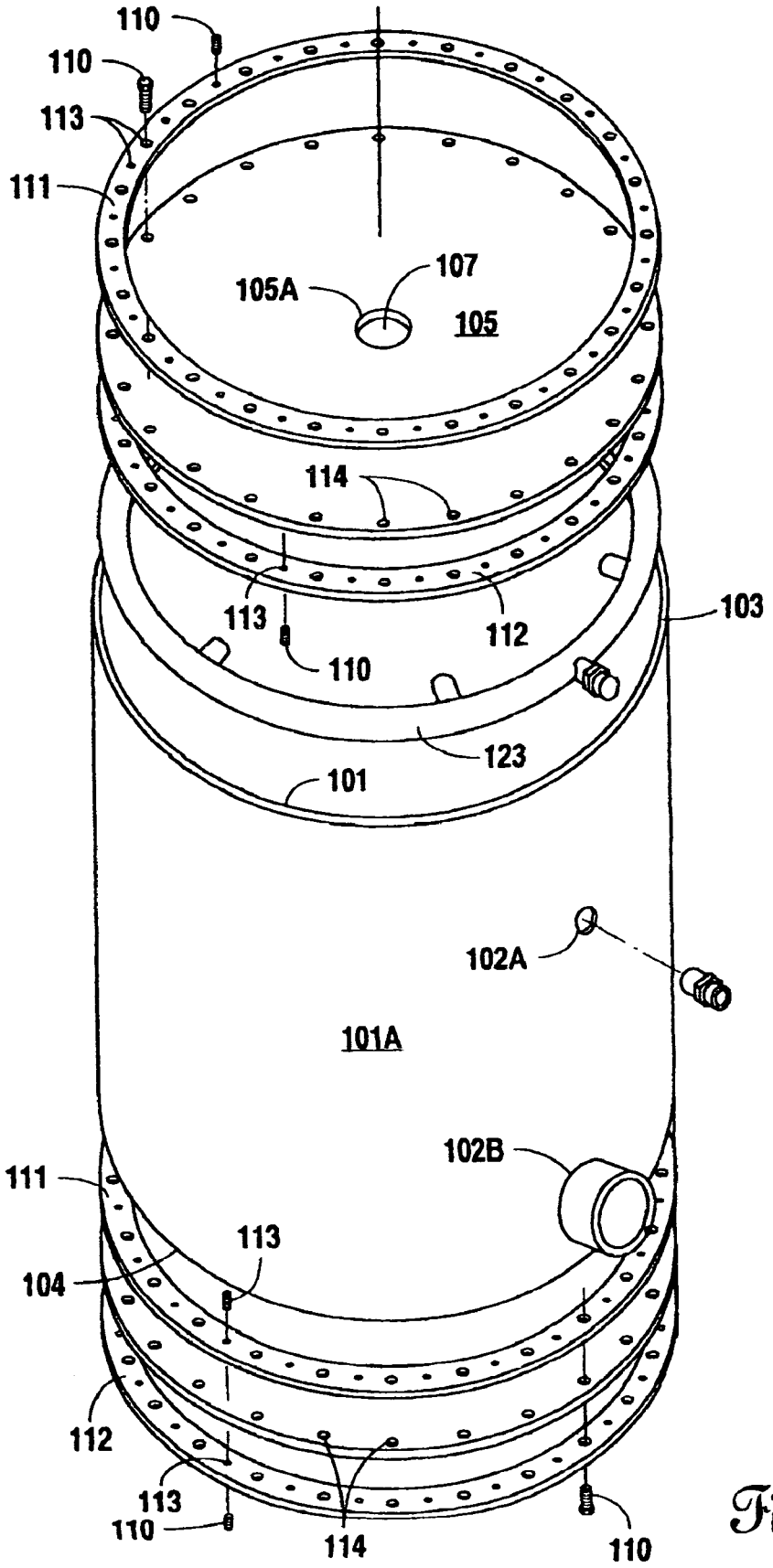
FIG. 2 is an exploded exterior view of components comprising parts of the apparatus of the present invention.
Figure 3:
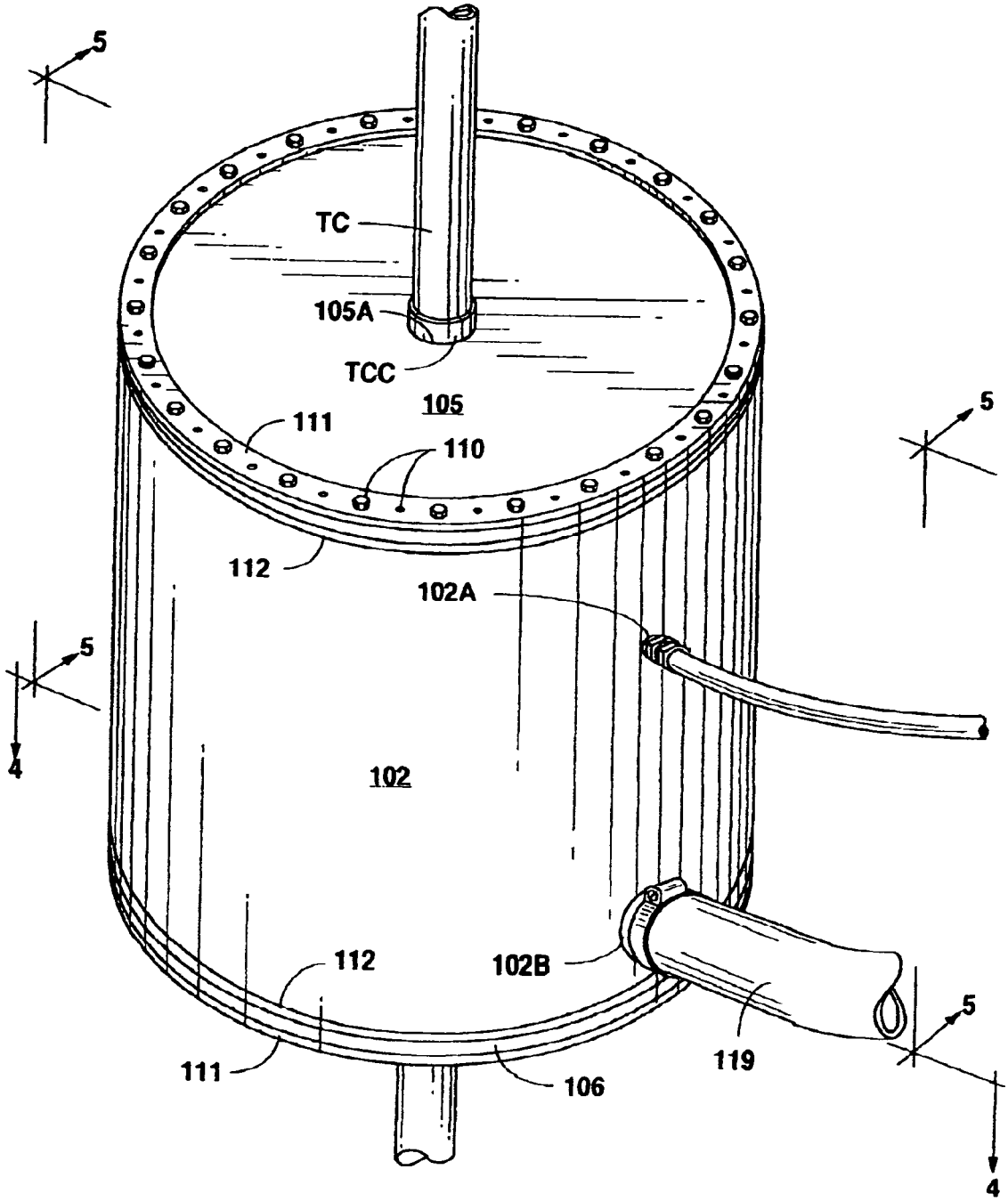
FIG. 3 is a perspective exterior view of the housing component with a tubular conduit disposed therein during washing.

FIG. 2 is an exploded view of the housing 101A and associated components. The cylindrical housing 101A is preferably made of stainless or other steel or metal and has a smooth interior wall 101 (FIG. 5) and an exterior elongated outer surface 102. The housing 101A has an upper end 103 and a lower end 104 across which are placed upper and lower removable elastomeric seal means 105 and 106, respectively. The seal means 105 and 106 preferable are composed of gum rubber. Gum rubber is a commercially available commodity. Preferably, I use a gum rubber for making the gasket seal means 105, 106 identified as "Style #135", sold by Ross Seal Company, P.O. Box 73345, Houston, Tex., 77273-0345. This product is a full floating natural gum rubber. It is tan in color with a smooth finish. It has a Durometer (Shore A) reading of between 35 and 45. Its typical tensile strength is between about 3,000 and 4,000 p.s.i. Its ultimate elongation is 600%, minimum. Its approximate weight is 2.9 pounds per square yard. It may be used at operating temperatures from −20 degrees F. to +180 degrees F., at a maximum pressure exposure of about 250 p.s.i.

Each seal means 105 and 106 has a centrally located opening defining a passageway 107, 108 having a diameter such that a circumferentially extending lip area, 105A, 105B, of each seal means 105 and 106 defines the outer boundary or diameter of the passageways 107, 108 and may snugly contact the outer surface of the tubular conduits TC passing through the interior of the housing 101A during trip out and during the washing process, as described below. The upper and lower ends 103 and 104 of the housing 101A contain a series of circumscribed screw bores 109 for insertion there through of screws or bolts 110. Upper and lower gaskets 111, 112 are placed above and below, respectively, the elastomeric seal means 105 and 106, the gaskets also having screw bores 113 there around. Likewise, screw bores 114 are provided around the outer edge of each seal means 105 and are in alignment with the bores 113 and 114. The lower gaskets 112 are placed around the respective ends 103 and 104. Thereafter, the elastomeric seal means 105 and 106 are respectively placed outwardly of the gaskets 112 and the upper gasket 111 is placed around the outer face of the respective seal means 105, 106. The screw bores 109, 113 and 114 are placed into alignment such that screws 115 are threadedly engaged within the bores 109, 113 and 114 to selectively secure the seal means 105 and 106 onto the cylindrical housing 101A. When the seal means 105 and 106 are in such placement upon the housing 101A, and a tubular conduit TC is inserted through the seals 105, 106 and the housing 101A, an interior chamber 101A-1 is so defined. The procedure is reversed when replacement of the seal means 105 and 106 is required.

The elongated outer surface 102 of the cylindrical housing has two ports 102A and 102B for communication with the interior chamber 101A-1. The first port 102A provides means for selective sealing attachment of a wash fluid line 116 extending from the housing 101A to a pump and motor 117 (FIG. 6) and container 118 for storage of the selected wash fluid WF. The second port 102B provides means for selective sealing attachment of a vacuum line 119 extending from the interior of the housing 101A to means for generating a vacuum (pump and motor) 120 and a storage tank 121 (FIG. 6), for applying a vacuum within the chamber 101A-1 to urge spent wash fluid WF and undesirable matter UM into the storage tank 121 for proper disposal.

Figure 4:
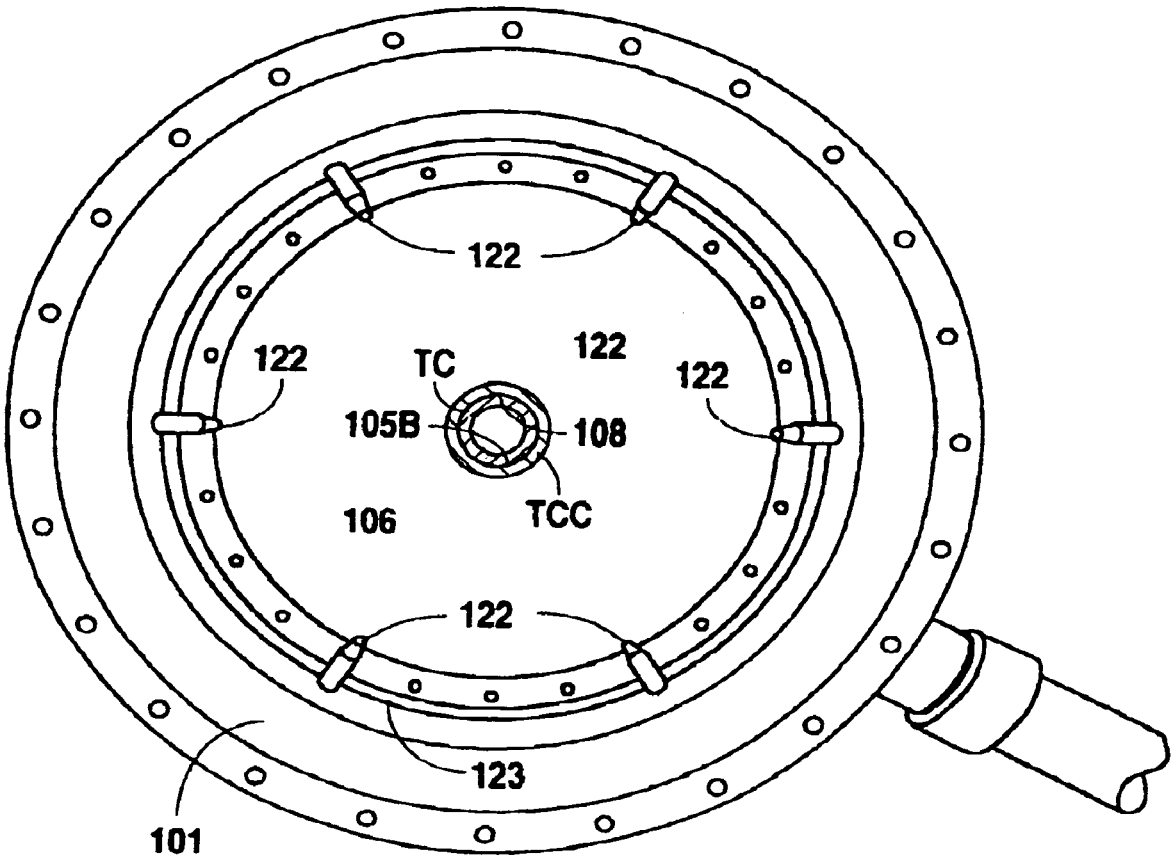
FIG. 4 is a perspective view, taken along line 4-4 of FIG. 3, looking down and into the interior of the cylindrical housing of the apparatus.
Figure 5:
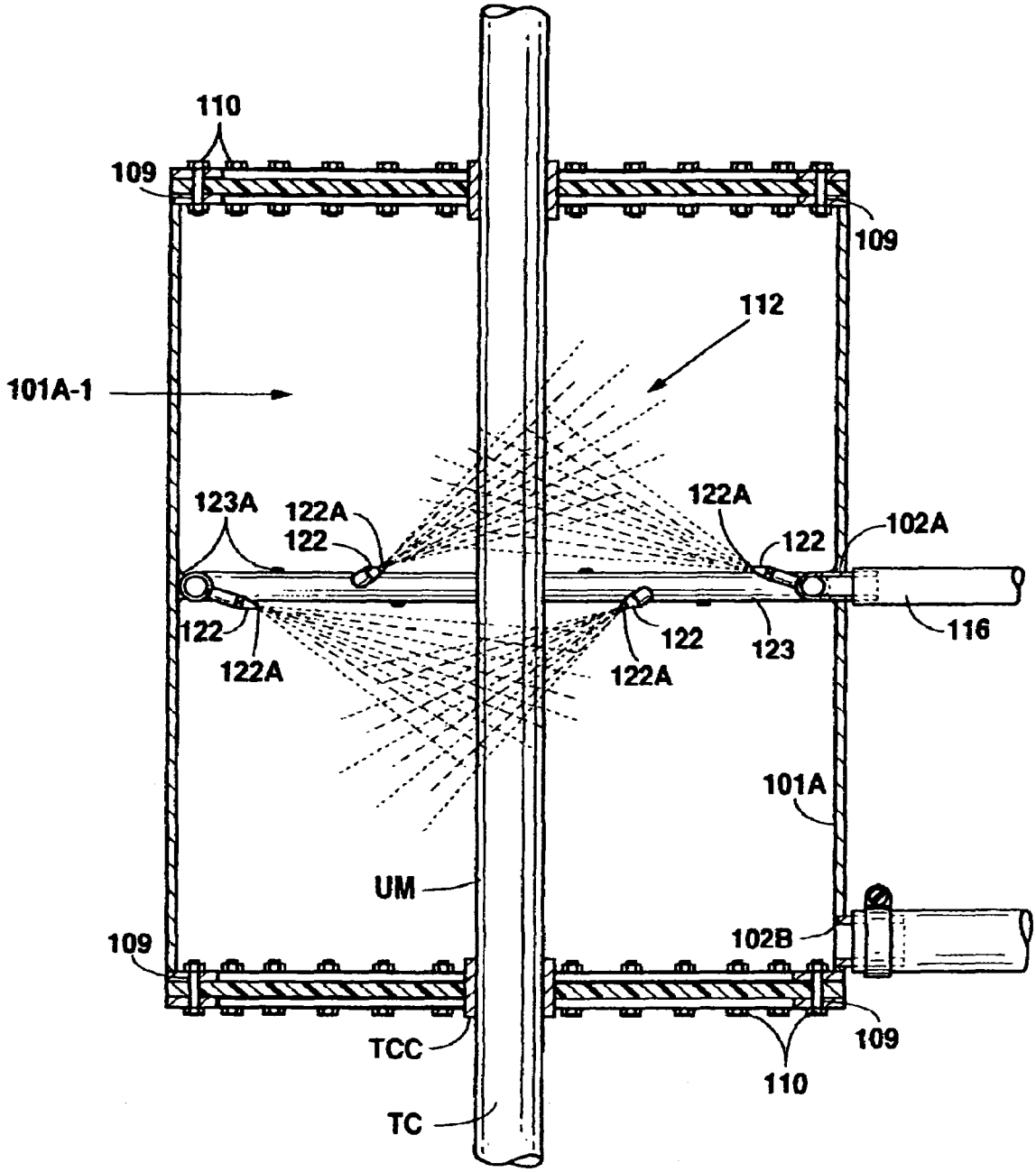
FIG. 5 is a horizontal cross-sectional view of the housing, taken along line 5-5 of FIG. 3.

Now, with reference to FIGS. 4 and 5, a series of jet nozzles 122 having openings 122A providing a pattern 122B of spray for the pressurized wash fluid WF are secured into sections of metallic or similar piping 123 joined together between the nozzles and having an interior passageway for communication with the wash fluid line 116. The piping sections 123 may be secured to the interior wall 101 of the housing 101A at spot welds 123A. The spray pattern 122B resulting from the angles of the openings 122A of the nozzles 122 may be adjusted for maximum cleaning with little or no experimentation. The nozzles 122 may be placed and spaced to provide alternating or varying patters 122B of spray for the wash fluid WF. Several sections of spray nozzle series may be provided on piping 123 in a vertical array of choice. The spray pattern desired may be influenced by the make up of the undesirable matter on the conduit string CS withdrawn from a particular well W, as well as the specific chemical composition of the wash fluid WF, the temperature at injection and the pressure applied through the nozzles 122. The injection pressure of the wash fluid WF through the opening at the nozzles is typically provided at from between about 100 p.s.i. and about 10,000 p.s.i.

The wash fluid WF may be used in the cleaning process at ambient temperature or may be heated to any desired level up to and including conversion to steam, by use of gas or electrically powered heater 124.

Operation

Figure 6:
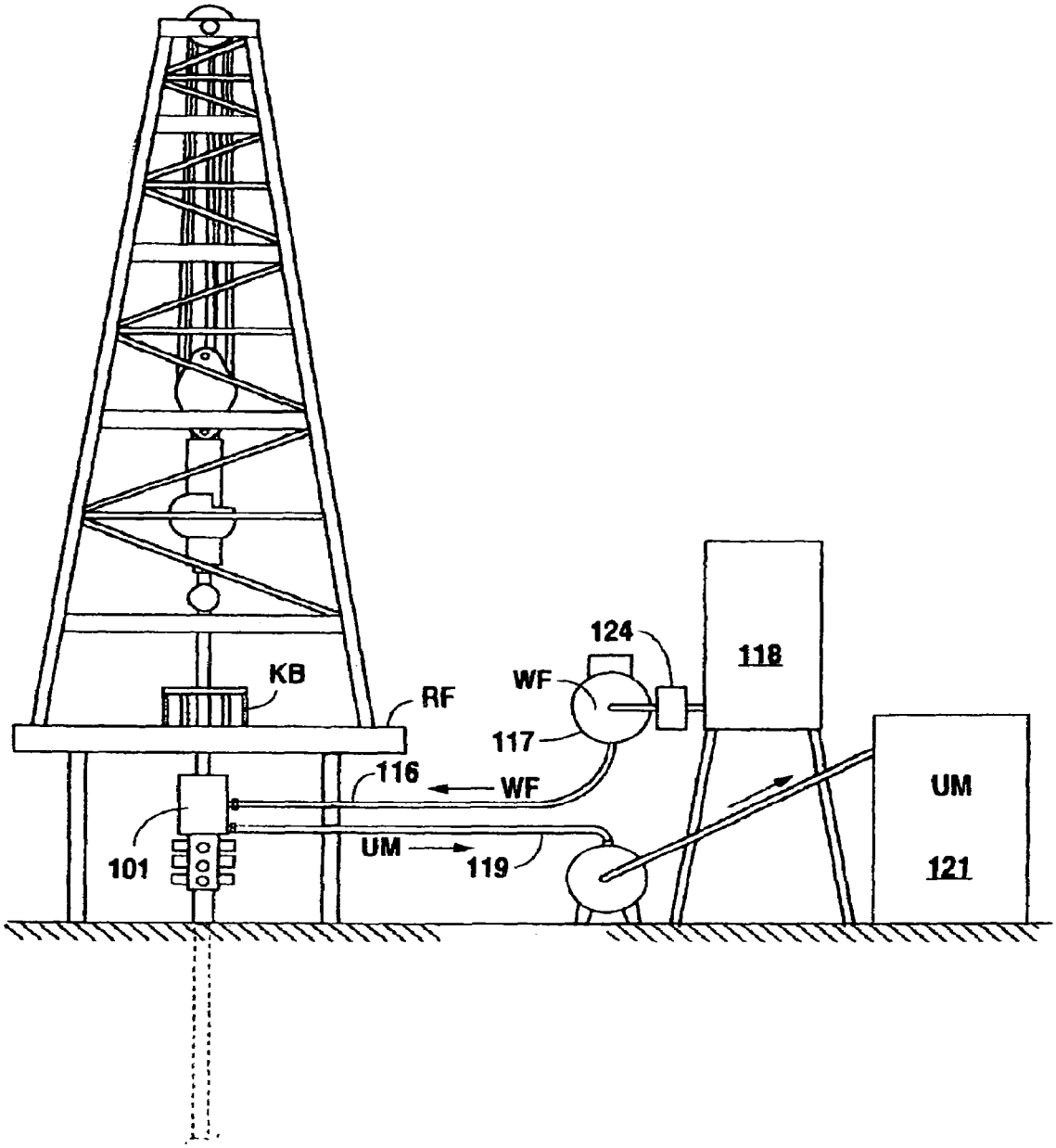
FIG. 6 is a schematic illustration of the vacuum, pump and storage components of the present invention.

Now referring to FIG. 6, the selected wash fluid WF is made up and stored in the wash fluid container 118, located in any proximity to the well W as desired, and the lines 116 and 119 made ready for connection to the connector/ports on the outer housing wall or surface 102. The housing and seal means, assembled as above, is then located on the rig floor. When it is desired to trip out the conduit string CS from within the well W, the apparatus 100 (housing, seal gaskets) is placed over the uppermost end of the top tubular conduit TC, which is held in place above the rotary table RT in the Kelly bushing KB. The swivel and traveling block TB are drawn upwardly from the upper end or collar of the tubular conduit TC, so held, and the apparatus 100 positioned over the tubular conduit TC such that the conduit TC is introduced through the lower gasket 112 opening 108, such that the lip area 105B contacts the outer surface of the tubular conduit TC but the contact is insufficient to effectively resist or prevent movements of the tubular conduit TC through the housing 101 during tripping in or out of the well W. The apparatus 100 is held by roughnecks and slight downward force is applied to the housing 101 to urge the tubular conduit TC through the interior of the housing 101 and thence through the opening 107 in the upper seal gasket 111, with the lip surface 105A contacting the outer surface of the tubular conduit TC as the collar at the upper end of the tubular conduit TC moves upwardly and out of the seal gasket 111. The Kelley and swivel are lowered and connection to the collar of the upper tubular conduit is effected by use of power tongs, or the like.

The apparatus 100 now is moved down below the rig floor RF and into the cellar C and rig flooring placed over it. The lines 116 and 119 are now connected to the connector/ports on the outer wall or surface 102. The conduit string CS may now be tripped out of the well. At the same time, the pump for the wash fluid WF is activated and the fluid is ejected through the openings in the nozzles 122. The vacuum pump VP is activated. As the tripping operation is begun, the tubular conduits TC pass within the housing 101 and are washed. The undesirable matter removed therefrom is vacuumed out of the housing 100, together with the spent wash fluid WF, for storage in the container and for proper disposal thereafter.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for washing undesirable matter off of the exterior of tubular conduits forming a conduit string, during trip out from within a subterranean well, comprising:

(a): a cylindrical housing having first and second opposite ends and;

(b): a removable elastomeric seal means across each of said first and second ends and selectively attached relative to said cylindrical housing, each said seal means defining an open passageway there through disposed centrally there across and sized for introduction of said tubular conduits into and out of said cylindrical housing and including a circumferentially extending lip area facing said passageway for snug, wiping contact around the exterior of the tubular conduits during movements of the conduit string into and out of the cylindrical housing;

(c): means for selectively attaching and removing said elastomeric seal means from said apparatus and for replacing said seal means with other seal means;

(d): a plurality of wash means placed circumferentially within and around the interior of the cylindrical housing for directing a cleaning fluid under pressure toward and upon the tubular conduits as the conduit string passes through the cylindrical housing during trip out from within the subterranean well;

(e): means for introducing a cleaning fluid into the wash means; and (f): means for recovering and removal of the cleaning fluid from within the cylindrical housing subsequent to directing of the cleaning fluid toward and upon the tubular conduits.

2. The apparatus of claim 1, wherein said wash means comprises jet nozzles having openings therein for directing said cleaning fluid as a spray toward and upon said tubular conduits.

3. The apparatus of claim 1, wherein said wash means comprises jet nozzles positioned in series such that the openings within such nozzles provide varying patterns of spray of the cleaning fluid toward and upon the tubular conduits.

4. The apparatus of claims 1, 2 or 3, further including a wash fluid conduit for supplying the cleaning fluid, and having one end in fluid communication with the wash means and another end in fluid communication with a stored source of cleaning fluid.

5. The apparatus of claim 1 wherein the jet nozzles are carried on a ring member secured to the interior of the cylindrical housing, the ring member having an interior passageway therein for transmission of the cleaning fluid into the jet nozzles.

6. The apparatus of claim 1, wherein the pressure of the cleaning fluid directed upon the tubular conduits being cleaned is maintained between about _____ p.s.i. and about _____, during washing of the tubular conduits within the housing.

7. The apparatus of claims 1, further comprising heating means for heating of the cleaning fluid prior to washing of the tubular conduits.

8. The apparatus of claim 1, further comprising heating means for heating of the cleaning fluid to a temperature of from between about _____ degrees F. and about _____ degrees F. prior to washing of the tubular conduits.

9. The apparatus of claim 1 wherein the elastomeric seal is comprised of gum rubber.

10. The apparatus of claim 1 wherein the elastomeric seal means further provides securement of the apparatus to the conduit string as the tubular conduits pass therethrough.

11. An apparatus for washing undesirable matter off of the exterior of tubular conduits forming a conduit string, during trip out from within a subterranean well, comprising:

(a) a cylindrical housing having first and second opposite ends;

(b) a removable elastomeric seal means across each of said first and second ends and selectively secured relative to said cylindrical housing, each said seal means defining an open passageway there through disposed centrally there across and sized for introduction of said tubular conduits into and out of said cylindrical housing and including a circumferentially extending lip area facing said passageway for snug, wiping contact around the exterior of the tubular conduits during movements of the conduit string into and out of the cylindrical housing;

(c) a plurality of wash means placed circumferentially within and around the interior of the cylindrical housing for directing a cleaning fluid under pressure toward and upon the tubular conduits as the conduit string passes through the cylindrical housing during trip out from within the subterranean well;

(d) means for introducing a cleaning fluid into the wash means;

(e) means for recovering and removal of the cleaning fluid from within the cylindrical housing subsequent to directing of the cleaning fluid toward and upon the tubular conduits; and (f) a chamber formed interiorally of the cylindrical housing and the seal means when a tubular conduit is disposed through the cylindrical housing and the seal means; and vacuum means for maintaining the chamber under a vacuum during washing of said tubular conduits and to remove from within the cylindrical housing cleaning fluid and the undesirable matter.

12. An apparatus for washing undesirable matter off of the exterior of tubular conduits forming a conduit string, during trip out from within a subterranean well, comprising:

(a) a cylindrical housing having first and second opposite ends;

(b) a removable elastomeric seal means across each of said first and second ends and selectively secured relative to said cylindrical housing, each said seal means defining an open passageway there through disposed centrally there across and sized for introduction of said tubular conduits into and out of said cylindrical housing and including a circumferentially extending lip area facing said passageway for snug, wiping contact around the exterior of the tubular conduits during movements of the conduit string into and out of the cylindrical housing;

(c) a plurality of wash means placed circumferentially within and around the interior of the cylindrical housing for directing a cleaning fluid under pressure toward and upon the tubular conduits as the conduit string passes through the cylindrical housing during trip out from within the subterranean well;

(d) means for introducing a cleaning fluid into the wash means;

(e) means for recovering and removal of the cleaning fluid from within the cylindrical housing subsequent to directing of the cleaning fluid toward and upon the tubular conduits; and (f) vacuum means for removing cleaning fluid and undesirable matter from within the interior of the housing means.

13. The apparatus of claim 12 further comprising: storage means in fluid communication with the vacuum means for storage of the removed cleaning fluid and the undesirable matter.

14. A method for washing undesirable matter off of the exterior of tubular conduits forming a conduit string, during trip out from within a subterranean well, comprising the steps of:

(1) providing at the well an apparatus comprising:

(a) a cylindrical housing having first and second opposite ends and;

(b) a removable elastomeric seal means across each of said first and second ends and selectively attached relative to said cylindrical housing, each said seal means defining an open passageway there through disposed centrally there across and sized for introduction of said tubular conduits into and out of said cylindrical housing and including a circumferentially extending lip area facing said passageway for snug, wiping contact around the exterior of the tubular conduits during movements of the conduit string into and out of the cylindrical housing;

(c) means for selectively attaching and removing said elastomeric seal means from said apparatus and for replacing said seal means with other seal means;

(d) a plurality of wash means placed circumferentially within and around the interior of the cylindrical housing for directing a cleaning fluid under pressure toward and upon the tubular conduits as the conduit string passes through the cylindrical housing during trip out from within the subterranean well;

(e) means for introducing a cleaning fluid into the wash means; and (f) means for recovering and removal of the cleaning fluid from within the cylindrical housing subsequent to directing of the cleaning fluid toward and upon the tubular conduits.

(2) positioning the apparatus above the well whereby the tubular string passes into, through and out of the apparatus during washing;

(3) introducing the cleaning fluid under pressure into the wash means and the interior of the cylindrical housing for washing of the tubular conduits as the conduit string is tripped out of the well;

(4) recovering and removing from within the cylindrical housing cleaning fluid including undesirable matter; and (5) removing said seal means and replacing said seal means with other seal means.

15. A method for washing undesirable matter off of the exterior of tubular conduits forming a conduit string, during trip out from within a subterranean well, comprising the steps of:

(1) providing at the well an apparatus comprising:

(a) a cylindrical housing having first and second opposite ends and;

(b) a removable elastomeric seal means across each of said first and second ends and selectively secured relative to said cylindrical housing, each said seal means defining an open passageway there through disposed centrally there across and sized for introduction of said tubular conduits into and out of said cylindrical housing and including a circumferentially extending lip area facing said passageway for snug, wiping contact around the exterior of the tubular conduits during movements of the conduit string into and out of the cylindrical housing;

(c) a plurality of wash means placed circumferentially within and around the interior of the cylindrical housing for directing a cleaning fluid under pressure toward and upon the tubular conduits as the conduit string passes through the cylindrical housing during trip out from within the subterranean well;

(d) means for introducing a cleaning fluid into the wash means; and (e) means for recovering and removal of the cleaning fluid from within the cylindrical housing subsequent to directing of the cleaning fluid toward and upon the tubular conduits:

(2) positioning the apparatus above the well whereby the tubular string passes into, through and out of the apparatus during washing;

(3) introducing the cleaning fluid under pressure into the wash means and the interior of the cylindrical housing for washing of the tubular conduits as the conduit string is tripped out of the well; and (4) recovering and removing from within the cylindrical housing cleaning fluid including undesirable matter, while applying a vacuum within the cylindrical housing to urge the recovery and removal of the cleaning fluid including the undesirable matter.

16. The method of claim 15, wherein in step "1", the wash means comprises jet nozzles having openings therein for directing said cleaning fluid as a spray toward and upon said tubular conduits.

17. The method of claim 15, wherein in step "1", the wash means comprises jet nozzles positioned in series such that the openings within such nozzles provide varying patterns of spray of the cleaning fluid toward and upon the tubular conduits.

18. The method of claim 15, wherein in step "1", the apparatus further comprises a wash fluid conduit for supplying the cleaning fluid, and having one end in fluid communication with the wash means and another end in fluid communication with a stored source of cleaning fluid.

19. The method of claim 15, wherein in step "1", the apparatus further comprises a chamber formed interiorally of the cylindrical housing and the seal means when a tubular conduit is disposed through the cylindrical housing and the seal means; and vacuum means for maintaining the chamber under a vacuum during washing of said tubular conduits and to remove from within the cylindrical housing cleaning fluid and the undesirable matter.

* * * * *